United States Patent [19]

Yamagata et al.

[11] 4,451,718

[45] May 29, 1984

[54] CIRCUIT BREAKER

[75] Inventors: Shinji Yamagata; Fumiyuki Hisatsune; Junichi Terachi; Kiyomi Yamamoto, all of Fukuyama; Hajimu Yoshiyasu, Itami; Yuichi Wada, Kawanishi, all of Japan

[73] Assignee: Mitsubishi Denki Kabushiki Kaisha, Tokyo, Japan

[21] Appl. No.: 351,314

[22] Filed: Feb. 22, 1982

[30] Foreign Application Priority Data

| | | | |
|---|---|---|---|
| Feb. 27, 1981 | [JP] | Japan | 56-28897[U] |
| Feb. 27, 1981 | [JP] | Japan | 56-28899[U] |
| Feb. 27, 1981 | [JP] | Japan | 56-28903[U] |
| Mar. 2, 1981 | [JP] | Japan | 56-30058[U] |

[51] Int. Cl.[3] ..... H01H 33/18

[52] U.S. Cl. ..... 200/147 R; 200/144 R; 335/195; 335/201

[58] Field of Search ..... 200/144 R, 147 R; 335/195, 201

[56] References Cited

U.S. PATENT DOCUMENTS

| | | | |
|---|---|---|---|
| 537,130 | 4/1895 | Sperry | 200/147 R |
| 568,459 | 9/1896 | Potter | 200/147 R |
| 2,555,799 | 6/1951 | Lerstrup | 200/147 R |
| 2,555,993 | 6/1951 | Oppel et al. | 200/147 R |
| 2,654,012 | 9/1953 | Cellerini | 200/147 A |
| 3,402,273 | 9/1968 | Davis | 200/144 R |
| 3,599,130 | 8/1971 | Murai . | |

FOREIGN PATENT DOCUMENTS

| | | | |
|---|---|---|---|
| 480164 | 7/1929 | Fed. Rep. of Germany | 200/147 A |
| 1765051 | 7/1971 | Fed. Rep. of Germany . | |
| 711726 | 7/1954 | United Kingdom | 200/147 A |

*Primary Examiner*—Robert S. Macon

*Attorney, Agent, or Firm*—Wenderoth, Lind & Ponack

[57] ABSTRACT

The present invention combines the provision of arc shields surrounding the contacts of a circuit breaker with a magnetic driving means to raise the arc voltage of an arc drawn across the contacts and to effectively drive the arc, whereby the performance of the circuit breaker is improved.

12 Claims, 16 Drawing Figures

CIRCUIT BREAKER

BACKGROUND OF THE INVENTION

This invention relates to circuit breakers and in particular relates to a novel circuit breaker constructed such that the arc voltage of an arc drawn across the contacts during the operation of the circuit breaker is greatly raised, and the arc is magnetically driven to stretch the arc such that the arc is efficiently extinguished.

In prior-art circuit breakers, there is the defect that the foot of the arc struck across the gap between the contacts spreads to the contactor conductor on which the contacts are mounted, such that it is difficult to adequately raise the arc voltage, and even where a magnetic driving means is incorporated to extinguish the arc, arc extinguishing has not been effected efficiently.

SUMMARY OF THE INVENTION

It is an object of this invention to greatly raise the arc voltage by providing arc shields surrounding the contacts of the circuit breaker to prevent the spread of the foot of the arc onto the contactor conductors, and at the same time to enable arc extinguishing to be carried out effectively by incorporating a magnetic driving means to drive the arc.

It is another object of the present invention to provide a circuit breaker which uses a blow-out coil as a magnetic driving means together with the abovementioned arc shields.

It is a further object of the present invention to provide a circuit breaker which uses a permanent magnet as a magnetic driving means together with the abovementioned arc shields.

It is still a further object of the present invention to provide a circuit breaker which uses magnetic flux plates that overlie the stationary rigid conductor as a magnetic driving means together with the abovementioned arc shields.

It is yet another object of the present invention to provide a circuit breaker wherein a second contact for arc shifting is provided in addition to the stationary-side contact, and a blow-out coil used as a magnetic driving means together with the abovementiond arc shields, which coil is connected between the abovementioned second contact and the stationary-side contact.

BRIEF DESCRIPTION OF THE DRAWINGS

In the drawings, like symbols denote like or corresponding parts.

DESCRIPTION OF THE PREFERRED EMBODIMENTS

Figure 1A:
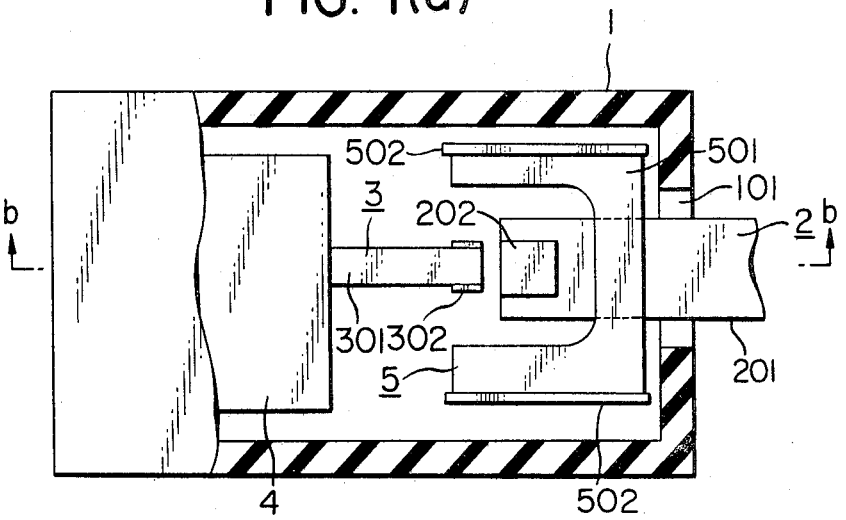
FIG. 1*a* is a sectional plan view of a conventional circuit breaker to which this invention is applicable.
Figure 1B:
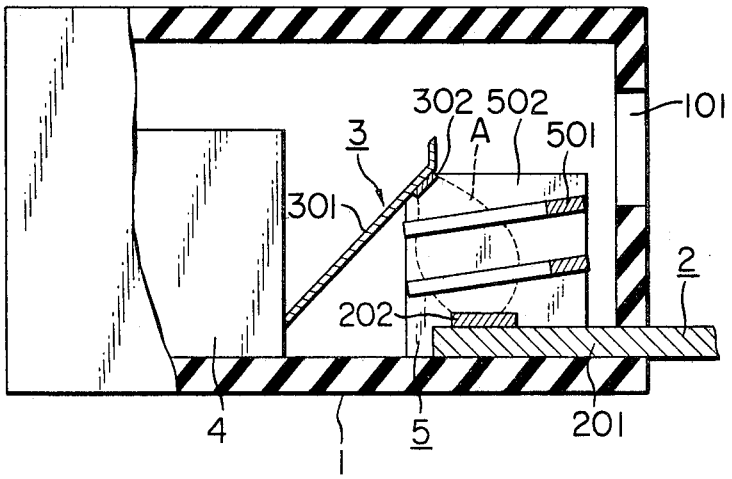
FIG. 1*b* is a sectional side view of the circuit breaker of FIG. 1*a* taken along the line b—b.
Figure 1C:
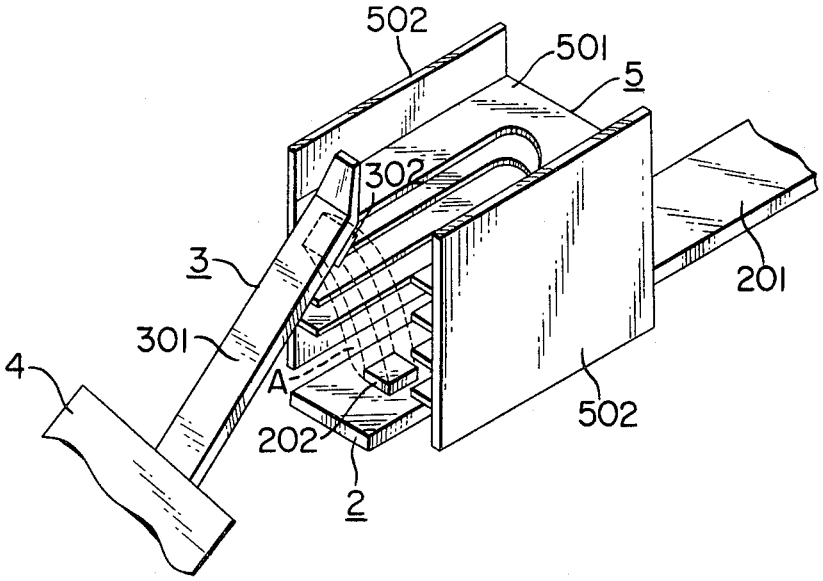
FIG. 1*c* is a perspective view showing the operation of the circuit breaker of FIG. 1*a;*

A conventional circuit breaker to which this invention is applicable will be described with reference to FIGS. 1*a*, 1*b*, and 1*c*.

An enclosure 1 is made of an insulating material, forming the housing for a switching device, and is provided with a gas exhaust port 101. A stationary contactor 2 housed in the enclosure 1 comprises a rigid stationary contactor conductor 201 which is rigidly fixed to the enclosure 1, and a stationary contactor contact 202 which is mounted on an electrically contacting surface of the conductor 201. A movable contactor 3 which is adapted to engage the stationary contactor 2 comprises a rigid movable contactor conductor 301 which makes or breaks contact with the stationary contactor conductor 201, and a movable contactor contact 302 which is mounted on an electrically contacting surface of the conductor 301 in opposition to the stationary contactor contact 202. An operating mechanism 4 operates to move the movable contactor 3 into or out of contact with the stationary contactor. An arc extinguishing plate assembly 5 functions to extinguish an electric arc A struck upon the separation of the movable contactor contact 302 from the stationary contactor contact 202, and has that a plurality of arc extinguishing plates 501 supported by frame plates 502.

The operating mechanism 4 is well known in the art, and is described, for example, in U.S. Pat. No. 3,599,130, "Circuit Interruptor", issued to W. Murai et al., Aug. 10, 1971. As apparent from the patent, the operating mechanism includes a reset mechanism.

In the case where the movable contactor contact 302 and the stationary contactor contact 202 are in contact, current flows from a power supply side to a load side along a path from the stationary conductor 201 to the stationary contactor contact 202 to the movable contactor contact 302 to the movable conductor 301. When, in this state, an overcurrent such as short-circuit current, flows through the circuit, the operating mechanism 4 operates to separate the movable side contactor contact 302 from the stationary contactor contact 202. At this time, an arc A appears across the gap between the contact 202 and the contact 302, and an arc voltage develops thereacross. The arc voltage rises as the distance of separation of the contact 302 from contact 202 increases. Also, the arc A is drawn toward the arc extinguishing plate assembly by the magnetic force, and the length of the arc is stretched by the arc extinguishing plates 501, further raising the voltage. Thus the arc current reaches the current zero point to extinguish the arc A, so that the interruption is completed.

During such interrupting operation, large quantities of energy are generated across the gap between the movable contactor contact 302 and the stationary contactor contact 202 in a short space of time of the order of several milliseconds, by the arc A. As a consequence, the temperature of the gas within the enclosure 1 rises abruptly, as does the pressure thereof, and the high temperature and pressure gas is vented into the atmosphere through the exhaust port 101.

The circuit breaker operates as explained above when breaking an overcurrent, but the performance capability expected of a circuit breaker during such operation is that the arc voltage be high, whereby the arc current flowing during the interruption operation is suppressed, and the magnitude of the current flowing through the circuit breaker is reduced. Accordingly, a circuit breaker which generates a high arc voltage offers a high level of protection to the electrical equipment, including the electrical wiring, disposed in series therewith. Heretofore, in circuit breakers of this type, separating the contacts at high speed or stretching the arc by means of magnetic force were used as means for attaining a high arc voltage, but in these cases, there was a certain limit to the rise in arc voltage, such that satisfactory results could not be achieved.

Now the behaviour of the arc voltage, etc., across the gap between the stationary contactor and movable contactor contacts 202 and 302 of the circuit breaker of FIGS. 1*a, b* and *c* will be explained.

In general, the arc resistance R(Ω) is given by the following expression:

$$R=\rho(l/S)$$

where $\rho$: arc resistivity (Ω.cm)

l: arc length (cm)

S: arc sectional area ($cm^2$)

In general, in a short arc A with a large current of at least several kA and an arc length l of at most 50 mm, the arc space is occupied by particles of metal from the rigid conductors on which the arc has its foot. Moreover, the emission of metal particles from the rigid conductors occurs orthogonally to the rigid conductor surfaces. At the time of the emission, the metal particles have a temperature close to the boiling point of the metal used in the rigid conductors, and whether they are injected into the arc space or not, they are injected with electrical energy, further raising the temperature and pressure, and taking on conductivity, and they flow away from the rigid conductors at high speed while diverging in a direction conforming with the pressure distribution in the arc space. The arc resistivity $\rho$ and the arc sectional area S in the arc space are determined by the quantity of metal particles produced and the direction of emssion thereof. Accordingly, the arc voltage is determined by the behaviour of such metal particles.

Figure 2:
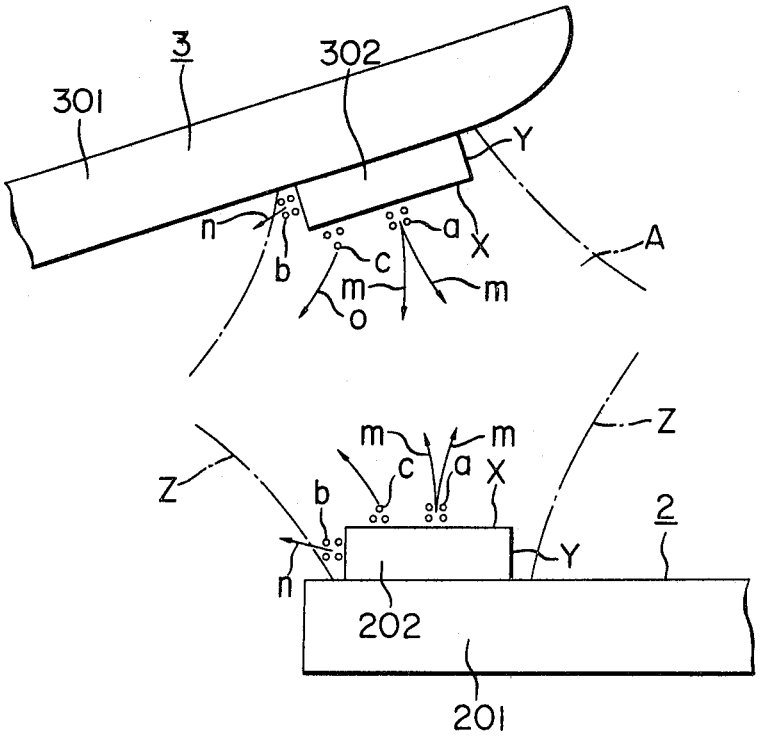
FIG. 2 is a diagram showing the behaviour of an electric arc struck across the gap between the contacts of the circuit breaker of FIG. 1*a;*

This behaviour of the metal particles is explained in conjunction with FIG. 2. In the figure, the stationary contactor contact 202 and the movable contactor 302 have surfaces X, the opposing contact surfaces when the respective contacts 202 and 302 are in contact, and surfaces Y, the electrically contacting surfaces of the contacts other than the surfaces X, and a portion of the surfaces of the rigid conductor. A contour Z indicated by a dot-and-dash line in the figure is the envelope of the arc A struck across the gap between the contacts 202 and 302. Further, metal particles a, b and c are typically representative of the metal particles which are respectively emitted from the surfaces X and Y of the contactors 2 and 3, with the metal particles a coming from the vicinity of the centre of the surfaces X, the metal particles b coming from the surfaces Y, portions of the surfaces of the contacts and of the surfaces of the rigid conductors, and the metal particles c coming from the peripheral portions of the opposing surfaces x located between the points of origin of the metal particles a and b. The paths of the respective metal particles a, b and c subsequent to emission respectively flow along the flow lines shown by the arrows m, n and o.

Such metal particles a, b and c emitted from the contactors 2 and 3 have their temperature raised from approximately 3,000° C., the boiling point of the metal of the contactors, to a temperature at which the metal particles take on conductivity, i.e., at least 8,000° C., or to the even higher temperature of approximately 20,000° C., and so energy is taken out of the arc space and the temperature of the arc space falls, the result of which is to produce arc resistance. The quantity of energy taken from the arc space by the particles a, b and c increases with the rise in the temperature, and the degree of rise in temperature is determined by the positions and emission paths in the arc space of the metal particles a, b and c emitted from the contactors 2 and 3. However, in FIG. 3, the particles a emitted from the vicinity of the centre of the opposing surfaces X take a large quantity of energy from the arc space, but the particles b emitted from the surfaces Y on the contacts and rigid conductors, compared to the particles a, take little energy from the arc space, and further the particles c emitted from the peripheral portion of the opposing surfaces X take out only an intermediate amount of energy approximately midway between the amounts of energy taken by the particles a and b.

That is to say, within the range in which the particles a flow, it is possible to take out large quantities of energy and to lower the temperature of the arc space, and hence to increase the arc resistivity $\rho$, but within the range in which the particles b and c flow, large quantities of energy are not taken out, and so the lowering of the temperature in the arc space is also small, and so no increase in the arc resistivity $\rho$ is achieved. Moreover, since the arc is produced from both the opposing surfaces X and the contactor surfaces Y, the cross-sectional area of the arc increases, and the arc resistance is consequently lowered.

This energy outflow from the arc space due to the contact particles is proportional to the electrically injected energy, and so if the quantity of particles a produced between the contacts 202 and 302, injected into the arc space were increased, the temperature in the arc space would, of course, be greatly lowered, with the result that the arc resistivity could be increased, and the arc voltage greatly raised.

A circuit breaker according to this invention breaks through the limits that existed with regard to the increase in arc voltage in prior-art conventional circuit breakers as hereinabove described, and by increasing the quantity of metal particles generated between the contacts and injected into the arc space, and by magnetically stretching the arc, it is possible to greatly raise the arc voltage.

Figure 3A:
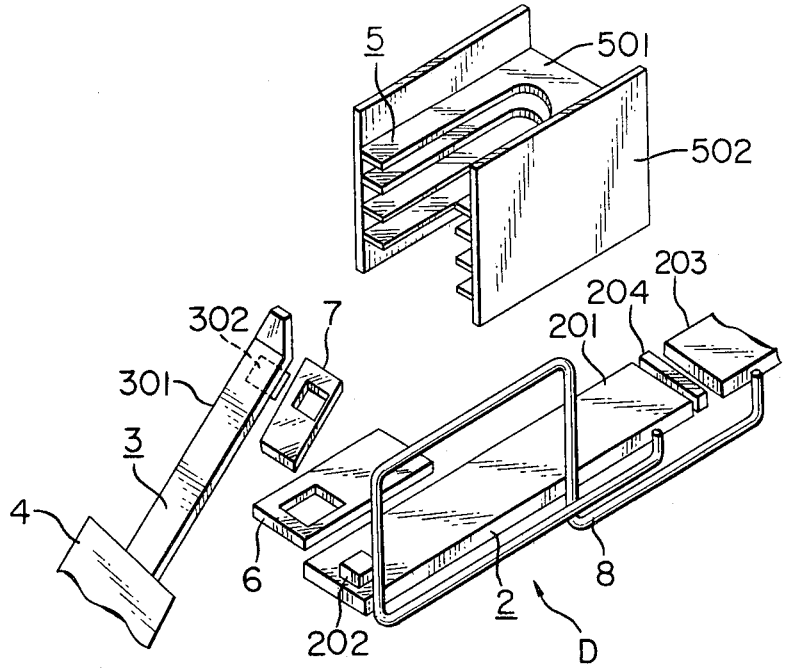
FIG. 3*a* is an exploded perspective view of an embodiment of a circuit breaker according to this invention.
Figure 3B:
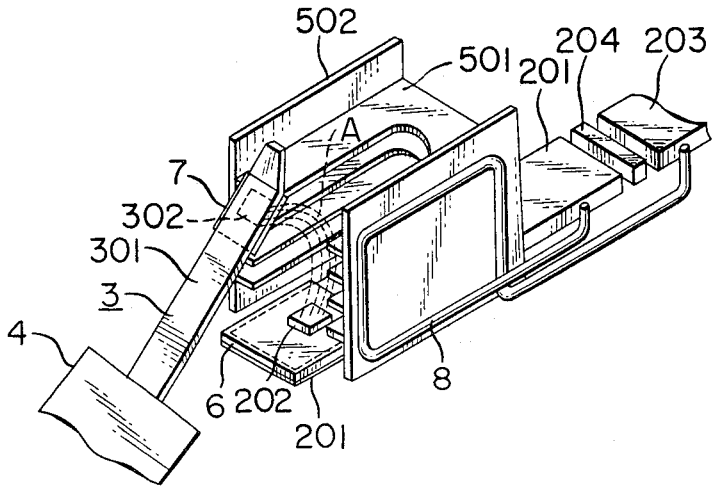
FIG. 3*b* is a perspective view showing the operation of the circuit breaker of FIG. 3*a;*

To this end, in the embodiment of the present invention shown in FIGS. 3*a* and 3*b*, a stationary contactor 2 and a movable contactor 3 respectively comprise a rigid stationary contactor conductor 201 and a rigid movable contactor conductor 301, to the respective ends of which are affixed a stationary contactor contact 202 and a movable contactor contact 302. The respective contactors 2 and 3 are disposed in mutual opposition such that the contacts 202 and 302 thereon can make or break a circuit. Further disposed on the respective rigid conductors 201 and 301 in a manner so as to surround the periphery of the contacts 202 and 302 are arc shields 6 and 7, respectively, formed of a high resistivity material having a resistivity higher than the rigid conductors 201 and 301. The high resistivity material of which the arc shields 6 and 7 are formed may, for example, be an organic or inorganic insulator, or a high resistivity metal such as copper-nickel, copper-magnanin, manganin, iron-carbon, iron-nickel, or iron-chromium, etc.

A blow-out coil 8 is connected at its one end to the stationary conductor 201, and at its other end to a portion 203 of the conductor insulated from the rigid conductor 201 by an insulator block 204. This blow-out coil 8 forms a single-winding coil that is disposed laterally of the area where the contacts open and close, and when a current flows, the blow-out coil 8 creates a magnetic flux that intersects the arc at right angles, the magnetic flux being wound in a direction that drives the arc in the direction of the arc extinguishing plate assembly 5 provided in the vicinity of the contacts. Further, the size of the blow-out coil 8 should be sufficient to encompass the stationary contactor contact 202 and the movable contactor contact 302 in both the open and closed circuit states, as viewed from the direction D in FIG. 3. The movable rigid conductor 301 is operated by the operating mechanism 4 to make or break contact with the stationary rigid conductor 201.

The operation of the circuit breaker of the above-described construction is substantially the same as that of the earlier described prior-art device, so the explanation thereof is omitted, but the behaviour of the metal particles between the contacts differs from that of the prior device, and so an explanation thereof now follows.

Figure 4:
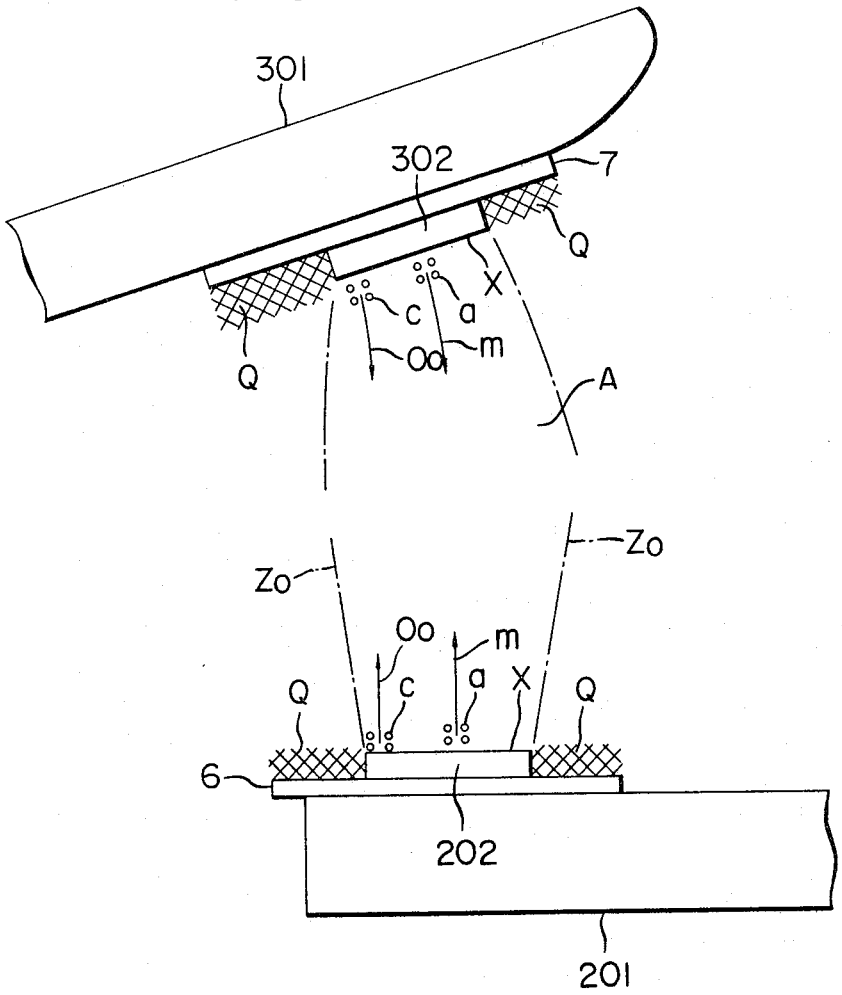
FIG. 4 is a diagram showing the effects of the arc shields provided in the circuit breaker of FIG. 3*a;*
Figure 5:
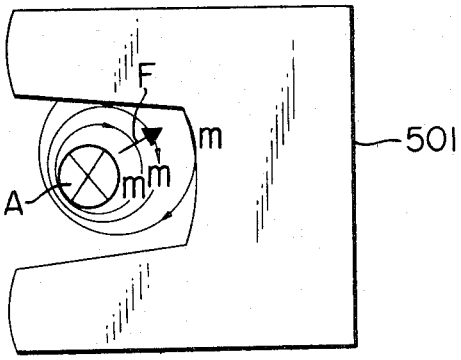
FIG. 5 is a diagram showing the general effects of arc extinguishing plates.
Figure 6A:
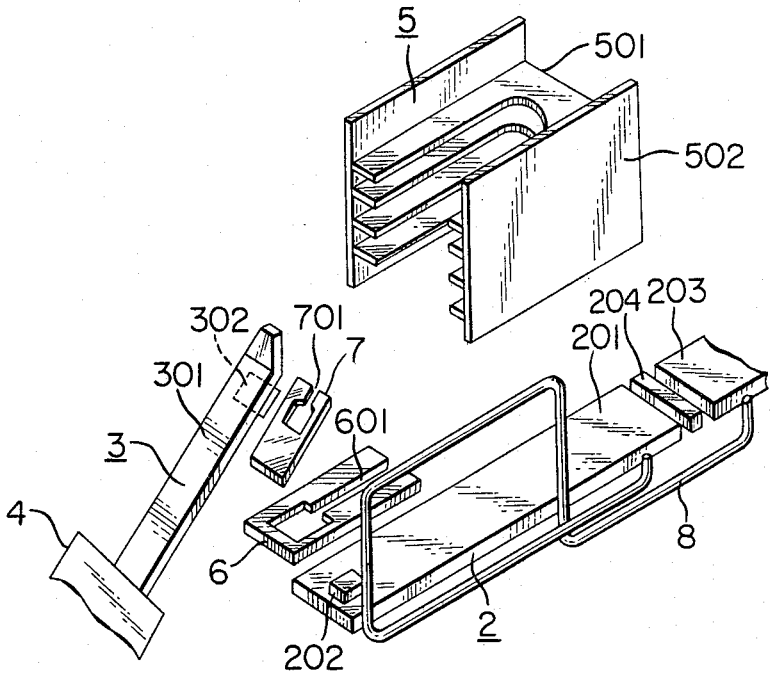
FIG. 6*a* is an exploded perspective view of another embodiment of a circuit breaker according to this invention.
Figure 6B:
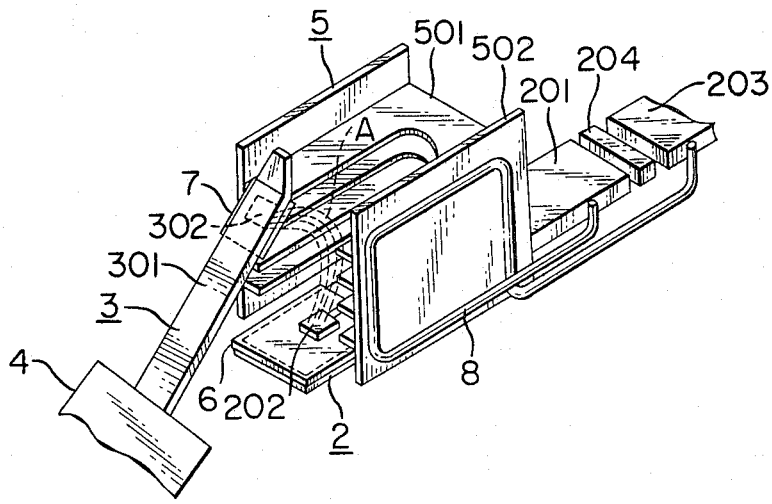
FIG. 6*b* is a perspective view showing the operation of the circuit breaker of FIG. 6*a;*

In FIG. 4, mutually opposing contacts 202 and 302 are respectively fixed to a stationary rigid conductor 201 and a movable rigid conductor on which are shields 6 and 7 are respectively provided so as to surround the periphery of the respective contacts, and to oppose the arc space, as described above. In the figure, X, a, c and n denote the same as in FIG. 3, and the dot-and-dash line $Z_o$ indicates the envelope of the space of arc A, which is contracted relative to FIG. 2 due to the presence of the arc shields, the arrow $O_o$ indicates the flow lines of the contact particles c that because of the presence of the arc shields flow in a different path from that of the prior-art device, and the intersecting oblique lines Q indicate the space in which the pressure generated by the arc A is reflected by the arc shields 6 and 7, raising the pressure which was lowered in the prior-art device without the arc shields 6 and 7.

The metal particles between the contacts in the circuit breaker of this invention behave as follows. The presure values in the space Q cannot exceed the pressure value of the space of the arc A itself, but much higher values are exhibited, at least in comparison with the values attained when the arc shields 6 and 7 are not provided. Accordingly, the relatively high pressure in the space Q produced by the arc shields 6 and 7 acts as a force to suppress the spread of the space of the arc A, and the arc A is confined to a small area. In other words, the flow lines of the contact particles a and c emitted from the opposing surfaces X are narrowed and confined to the arc space. Thus, the metal particles a and c emitted from the opposing surfaces X are effectively injected into the arc space with the result that a large quantity of effectively injected metal particles a and c take a quantity of energy out of the arc space of a magnitude that greatly exceeds that taken out in the prior-art, thus markedly cooling the arc space and hence causing a marked increase in the arc resistivity $\rho$, i.e. the resistance R, substantially raising the arc voltage.

However, as stated above, a blow-out coil 8 is provided together with the arc shields 6 and 7, and the magnetic flux produced by the blow-out coil 8 serves as a driving force acting on the arc A, so the arc A, of which the resistance has become great as described above, is further stretched, and is cooled by the arc extinguishing plates 501, and so the arc voltage across the contactors 2 and 3 is greatly raised.

In the event of an excess current flowing in relation to the rated current of a circuit breaker, e.g. when an excess current of 5,000 A or more flows with respect to a rated current of 100 A, the arc extinguishing phenomenon as described with reference to FIG. 4 will take place, but with a relatively small overcurrent of, say, 600 A or less with regard to a rated current of 100 A, such as may occur with normal use, it is the interruption performance at the current zero point, i.e. the restoration of the insulation of the arc space at the current zero point that becomes more of a problem than the current limiting performance of raising the arc voltage and suppressing the circuit current. This is for the following reason. The interruption current If is expressed by:

$$If = V/Z$$

wherein

V: Circuit Voltage

Z: Circuit Impedance

However, with the aforementioned relatively small current, the circuit impedance is very much larger than the arc resistance, and there is virtually no current limiting due to the arc. Accordingly, the current zero point occurs at a time point determined by the circuit impedance. In these circumstances, if the circuit impedance is large and the inductance is great, the momentary value of the circuit voltage at the current zero point is high, and to make interruption possible, the insulation of the arc space with regard to the difference in voltage between the abovementioned circuit voltage and the arc voltage, must be restored. On the other hand, when breaking large currents, i.e. when the circuit impedance is small, current limiting by the arc is great, and even at the current zero point it varies greatly in accordance with the degree of current limiting, reaching the zero point at the time when the arc insulation restoration power is sufficient, and so it is therefore possible to effect interruption following the lead of the arc insulation restoration power.

As explained above, in some instances small current interruption can be much more demanding with regard to interruption performance than large current interruption.

The arc space insulation restoration power is greatly affected by the cooling of the heat of the arc positive column. In order to achieve cooling with regard to the heat of the positive column, it has long been the practice, with regard to small currents, to absorb the heat directly by stretching the arc positive column and by means of a cooling member. Arc extinguishing plates are an example of such means, and are generally constructed of a magnetic material formed so as to easily draw and stretch the arc.

Figure 7A:
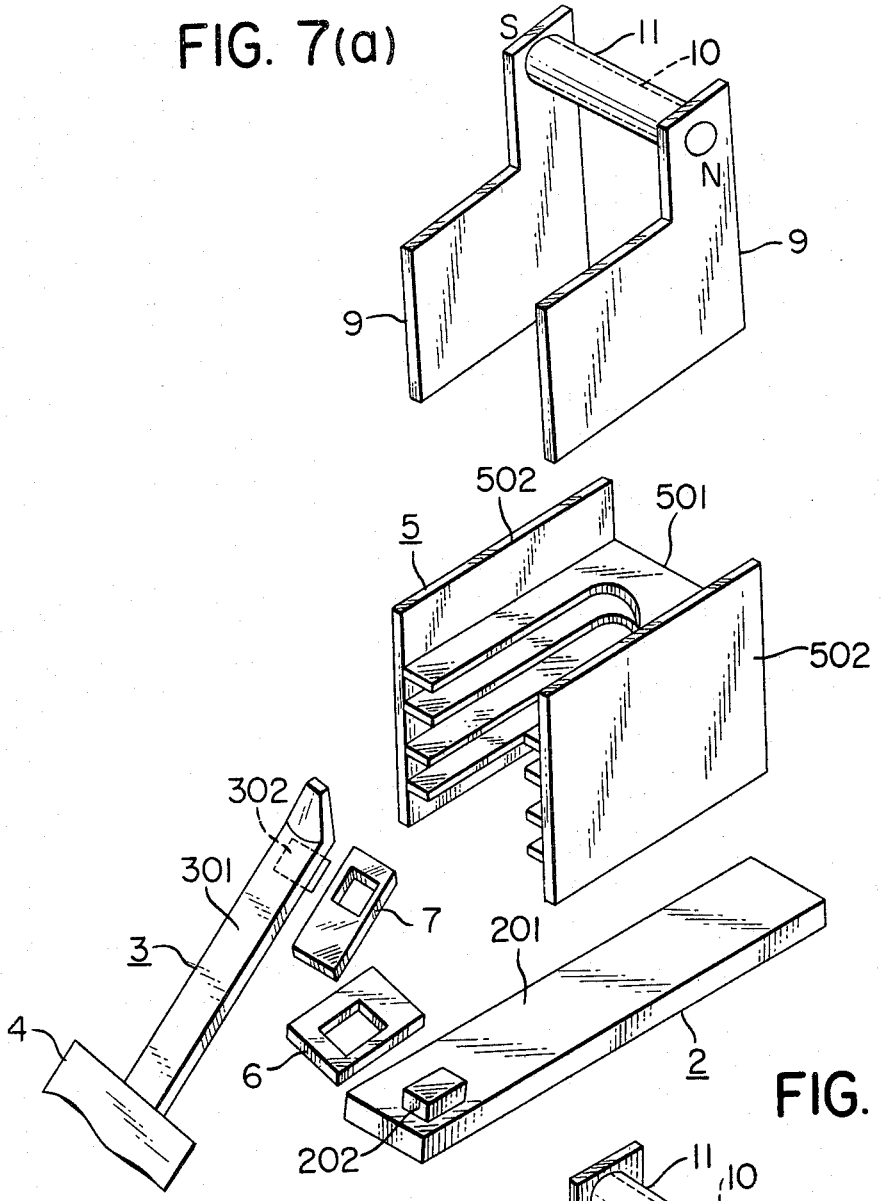
FIG. 7*a* is similarly an exploded perspective view of a circuit breaker according to another embodiment.
Figure 7B:
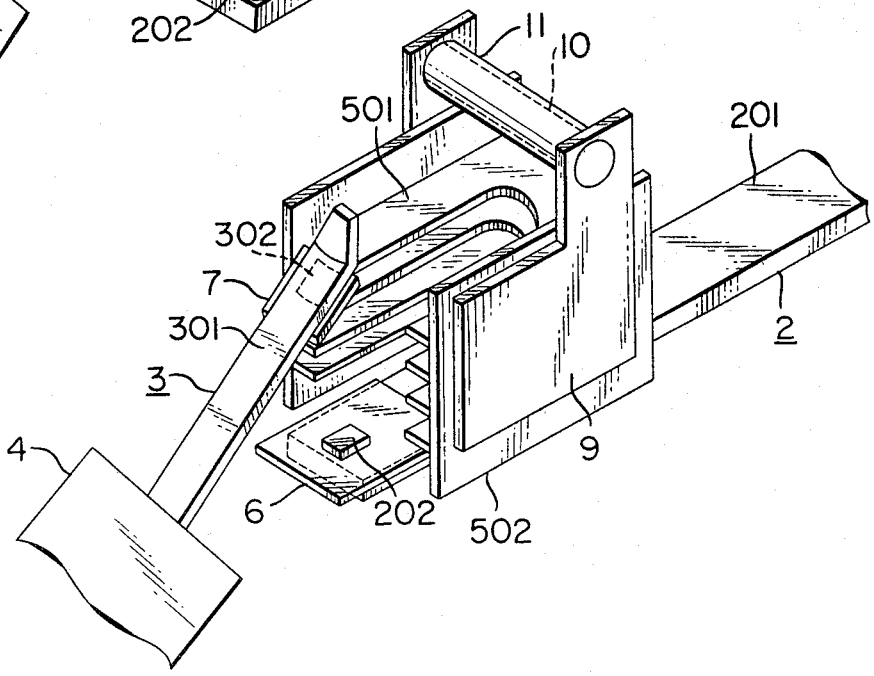
FIG. 7*b* is a perspective view showing the operation of the circuit breaker of FIG. 7*a;*
Figure 8A:
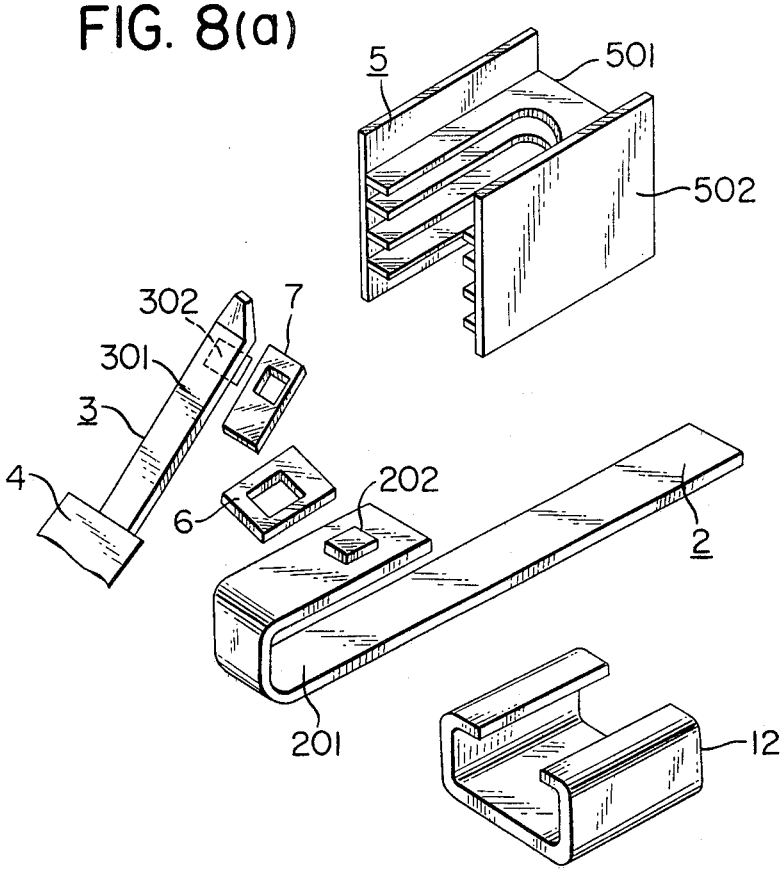
FIG. 8*a* is similarly an exploded perspective view of a circuit breaker according to another embodiment.
Figure 8B:
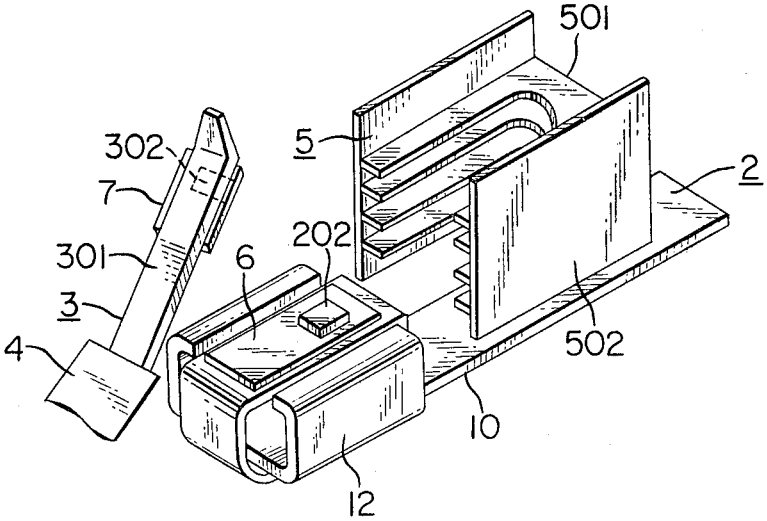
FIG. 8*b* is a perspective view showing the operation of the circuit breaker of FIG. 8*a;*
Figure 9A:
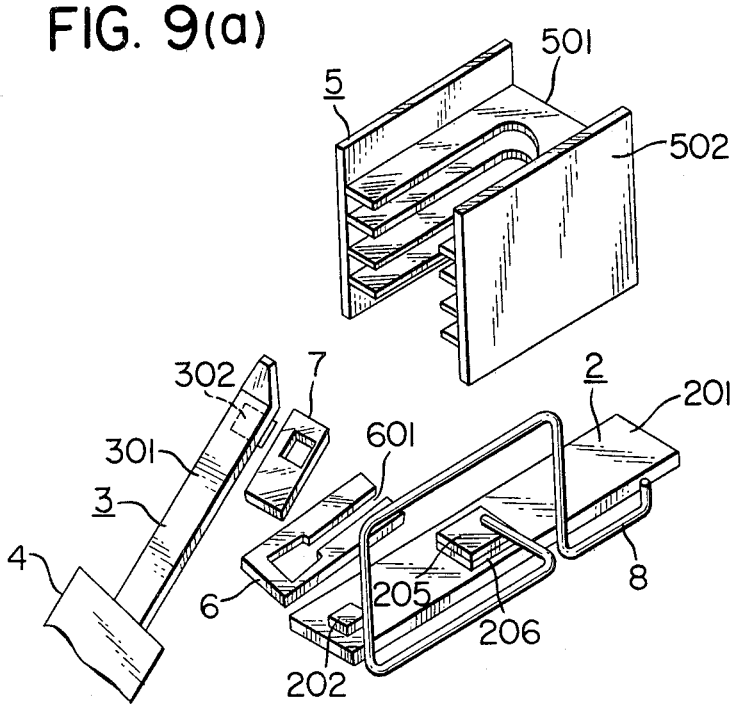
FIG. 9*a* is similarly an exploded perspective view of a circuit breaker according to another embodiment.
Figure 9B:
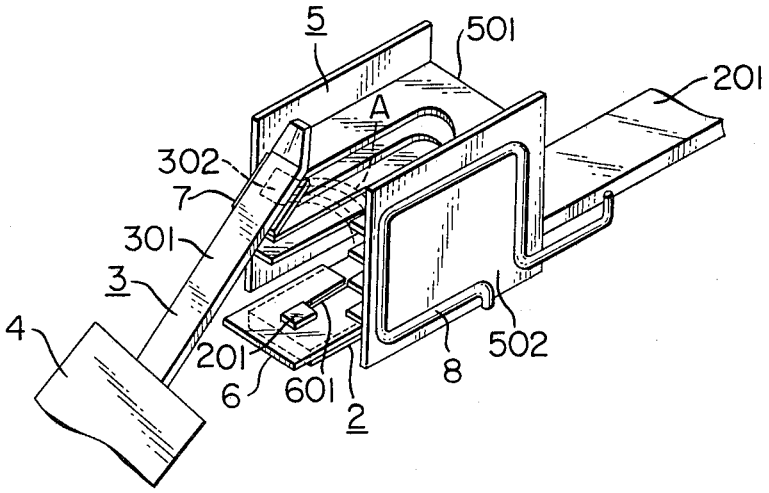
FIG. 9*b* is a perspective view showing the operation of the circuit breaker of FIG. 9*a*.

The relationship between the above described arc and the arc extinguishing plates is shown in FIG. 7, wherein an arc A exists with respect to the arc extinguishing plates 501, the current flows vertically in the drawing in a direction from the front of the drawing towards the rear. A magnetic field m is generated by the arc A, and the magnetic field in the periphery of the arc A is distorted by the effect of the arc extinguishing plates 501, the magnetic flux in the space near the magnetic members becoming ragged, and the magnetic field is ultimately drawn by the electromagnetic force in the direction F in the figure, i.e. the direction towards the arc extinguishing plates. In this way the arc is stretched, heat is absorbed by the arc extinguishing plates 501, and the insulation restoration power of the positive column is made great.

Another embodiment of the present invention is shown in FIGS. *6a* and *6b*, this embodiment including means for leading the arc in the direction of the arc extinguishing plates to further increase the effectiveness of the above described arc extinguishing plates. In this embodiment, the arc shields 6 and 7 are provided with slits 601 and 701, respectively, extending outwardly from the contacts 202 and 302. These slits 601 and 701 expose portions of the rigid conductors 201 and 301 in communication with the contacts 202 and 302.

The slits 601 and 701 are open-ended in the direction of the arc extinguishing plates 501, so the arc A is led by these slits 601 and 701 in the direction of the arc extinguishing plates 501, thus even more effectively stretching the arc positive column. As the result of this, the arc positive column makes direct contact with the arc extinguishing plates 501, whereby a large quantity of heat is absorbed, adequately cooling the arc to enable raised insulation restoration power when interrupting relatively small currents.

FIGS. *7a* and *7b* illustrate another embodiment of the present invention wherein a permanent magnet is employed as the magnetic field generating means, and in so far as a magnetic field of a fixed directionality is generated, it is particularly suited to direct current (DC) circuit breakers. On the two sides of the arc extinguishing plates 501 are disposed a pair of magnetic flux plates 9, formed of a magnetic material, that flank the contacts 202 and 203. A permanent magnet 10 is suspended between the magnetic flux plates 9, the outer periphery of the permanent magnet 10 being covered by an insulating tube to protect the magnet 10 against burning by the arc. The magnetic poles of the permanent magnet 10 adjoin to the magnetic flux plates 9, and their polarity is disposed such that the vector sum of the magnetic flux between the magnetic flux plates 9 and the arc current across the gap between the contacts 202 and 302 coincides with the direction towards the arc extinguishing plate 501.

The basic operation of the circuit breaker of the construction immediately above described is substantially similar to that of prior devices, so description thereof is omitted.

As stated above, the present embodiment is provided with magnetic flux plates 9 supporting a permanent magnet 10, assembled in such a manner that the vector sum of the magnetic flux between the magnetic flux plates 9 and the arc current coincides with the direction towards arc extinguishing plates 501. Thus the arc positive column is subjected to a strong driving force driving it in the direction of the arc extinguishing plates 501. As a result, the arc, the resistivity of which has been made large by the arc shields 6 and 7, is further stretched, and is then transected and cooled by the arc extinguishing plates, and so the arc voltage across the contactors 2 and 3 is greatly raised.

In this embodiment, the provision of slits 601 and 701 in the arc shields 6 and 7 respectively, does, of course, provide the same improvement with regard to interruption performance with relatively small currents, as described with respect to the embodiment illustrated in FIGS. *6a* and *6b*.

FIGS. *8a* and *8b* illustrate a further embodiment of the present invention, wherein a magnetic flux plate 12 formed of magnetic material is disposed adjacent the stationary contactor contact 202, which is surrounded by the arc shield 6. The magnetic flux plate 12 roughly forms a truncated U in cross-section, with the ends of the uprights of the U folded inwards with the end edges in spaced opposed relation to each other, and approaching the stationary contactor contact 202 from both sides. Also, the stationary contactor conductor 201 itself has the end to which the stationary contactor contact 202 is affixed, folded upwards and back into the shape of a U which intersects with the U-shaped magnetic flux plate 12, the magnetic flux plate 12 being affixed to the leg of the U of the rigid conductor 201 other than that on which the stationary contactor contact 202 is mounted. Bending the stationary rigid conductor 201 into a U-shape as aforesaid makes the directions of the current flowing in the two legs of the U mutually opposite, and so the directon of the magnetic field in the space opposing the leg portions becomes the same, and a strong magnetic field is obtained. Further, the provision of the above described magnetic flux plate 12 intersecting the stationary contact conductor 201, with the open ends of the U of the magnetic flux plate 12 bent in so as to approach the stationary contactor contact 202 from both sides, causes the magnetic flux generated by the current flowing in the stationary contactor conductor 201 to be concentrated in the vicinity of the stationary contactor contact 202. The magnetic field due to this magnetic flux links with the arc drawn across the gap between the contacts 202 and 302 to produce an arc driving force.

That is to say, in the present embodiment, the magnetic effect of the magnetic flux plate 12 in addition to the effects of the arc shields 6 and 7 described earlier, effectively extinguish the arc. In this embodiment, too, the provision of slits 601 and 701 in the respective arc shields 6 and 7 will of course further improve the interruption performance for relatively small currents, as described with respect to the embodiment illustrated in FIGS. *6a* and *6b*.

FIGS. *9a* and *9b* show yet another embodiment wherein a construction substantially similar to that of the embodiment illustrated in FIGS. *6a* and *6b* is employed, but which has added thereto a second contact 205 to form an excitation circuit for the blow-out coil 8. That is to say, in the present embodiment, a second contact 205 is disposed at the open end of the slit 601 provided in the arc shield 6 on the stationary contactor 2, i.e. the end toward arc extinguishing plates 501, and is fixed to the stationary rigid conductor 201 via an insulating plate 206. The blow-out coil 8 has one end joined to the second contact 205 and the other end joined to the stationary contactor conductor 201, and forms a coil of one winding on the outside of the side plate 502 of the arc extinguishing plate assembly 5.

Accordingly, when a large excess current flows in the circuit breaker and the operating mechanism 4 operates to separate the movable contactor contact 302 from the stationary contactor contact 202, an arc is drawn, but as explained with regard to FIG. 4, the arc is confined by the arc shields 6 and 7, and the rise in the arc voltage creates the current limiting effect, and then due to the magnetic force of the arc current one of the feet of the arc travels along the slit 601 in the stationary contactor arc shield 6 in the direction of the arc extinguishing plates 501, and when it reaches the second contact 205, the blow-out coil 8 is inserted into the current circuit. Thus, the blow-out coil 8 is excited, the arc A is stretched in the direction of the arc extinguishing plates 501, and is cooled and extinguished thereby. That is to say, in the circuit breaker according to this embodiment, the second contact 205 is provided in proximity to the arc extinguishing plates 501, and when the arc shifts to the contact 205 the blow-out coil 8 is excited, whereby the length of the arc is rapidly and greatly stretched in the direction of the arc extinguishing plates 501, and so the cooling and extinguishing effects of the arc extinguishing plates 501 can be effectively exploited. Further, the provision of the second contact 205 also has the effect of improving the wear characteristics of the stationary contactor contact 202, the arc shield 6 and the portion of the stationary contactor conductor 201 exposed by the slit 601.

It is to be understood that although only certain preferred embodiments of the present invention have been illustrated and described, various changes may be made in the form, details, arrangement and proportion of the parts of the circuit breaker, without departing from the scope of the invention which comprises the matter shown and described herein and set forth in the appended claims.

What is claimed is:

1. A circuit breaker comprising:

a pair of contactors each having a conductor having a contact affixed thereto;

means for operating said contactors to open and close an electrical circuit therethrough;

arc shields having a resistivity greater than that of said conductors and mounted on each of said contactors and surrounding said contacts for suppressing the spread of an arc generated between said contacts when said contacts are separated to open the electrical circuit;

at least one of said contactors having an arc travel path therealong having a resistivity smaller than that of said arc shields and disposed at one end thereof in the vicinity of said contacts for leading the arc along said arc travel path away from said contacts; and a magnetic driving means adjacent said contactors for generating a magnetic field that links with the magnetic field of the arc drawn across the contacts of said contactors when said contactors are operated to open the electrical circuit for driving the arc along said arc travel path.

2. A circuit breaker as claimed in claim 1 wherein said are shield has a slit therein extending away from said contact in the direction of arc travel, the surface of the conductor exposed by said slit constituting said arc travel path.

3. A circuit breaker as claimed in claim 1 wherein said pair of contactors comprises a stationary contactor and a movable contactor, and said magnetic driving means is a blow-out coil one end of which is connected to said stationary contactor, and an electrically conductive member on which the contact of said stationary contactor is mounted and insulatedly connected in said stationary contactor to which the other end of said blow-out coil is connected, whereby said blow-out coil is connected in said electrical circuit.

4. A circuit breaker as claimed in claim 3 wherein said arc shield has a slit therein extending away from said contact in the direction of arc travel, the surface of the conductor exposed by said slit constituting said arc travel path.

5. A circuit breaker as claimed in claim 1 wherein said magnetic drive means is a one bar permanent magnet, a pair of spaced opposed magnetic flux plates disposed on opposite lateral sides of said contactors with the space in which the contacts open and close being between said plates, said one bar magnet being connected between said plates, wherby the vector sum of the flux of the arc drawn across said contacts and the magnetic flux across said magnetic flux plates is caused to coincide with the direction of travel of said arc.

6. A circuit breaker as claimed in claim 5 wherein said arc shield has a slit therein extending away from said contact in the direction of arc travel, the surface of the conductor exposed by said slit constituting said arc travel path.

7. A circuit breaker as claimed in claim 1 wherein said pair of contactors comprises a stationary contactor and a movable contactor, and said magnetic driving means is a truncated U-shaped magnetic member around the conductor of said stationary contactor with the stationary contactor between the two ends thereof.

8. A circuit breaker as claimed in claim 7 wherein said arc shield has a slit therein extending away from said contact in the direction of arc travel, the surface of the conductor exposed by said slit constituting said arc travel path.

9. A circuit breaker as claimed in claim 1 wherein said pair of contactors comprises a stationary contactor and a movable contactor, the end portion of the conductor of said stationary contactor being bent back on itself in a U-shape, and said magnetic driving means is a truncated U-shaped magnetic member around the conductor of said stationary contactor with the stationary contactor between the two ends thereof.

10. A circuit breaker as claimed in claim 9 wherein said arc shield has a slit therein extending away from said contact in the direction of arc travel, the surface of the conductor exposed by said slit constituting said arc travel path.

11. A circuit breaker as claimed in claim 1 wherein said pair of contactors comprises a stationary contactor and a movable contactor, said stationary contactor having a second contact thereon for arc shifting in addition to said firstmentioned contact, an insulator plate between said second contact and said conductor of said stationary contactor, and said magnetic drive means is a blow-out coil that is connected at one end thereof to said second contact and at the other end thereof to said conductor of said stationary contactor.

12. A circuit breaker as claimed in claim 11 wherein said arc shield has a slit therein extending away from said contact in the direction of arc travel, the surface of the conductor exposed by said slit constituting said arc travel path.

* * * * *